US005816391A

United States Patent [19]

Harris

[11] Patent Number: 5,816,391

[45] Date of Patent: Oct. 6, 1998

[54] CLIP CARRIER WITH HANDLE

[75] Inventor: Randall L. Harris, Powder Springs, Ga.

[73] Assignee: Riverwood International Corporation, Atlanta, Ga.

[21] Appl. No.: 709,431

[22] Filed: Sep. 6, 1996

[51] Int. Cl.[6] ..... B65D 75/00

[52] U.S. Cl. ..... 206/147; 206/159; 206/175; 206/427

[58] Field of Search ..... 206/139, 141, 206/145, 147, 148, 149, 151, 159, 162, 165, 170, 174, 175, 193, 194, 197, 199, 200, 427

[56] References Cited

U.S. PATENT DOCUMENTS

| | | | |
|---|---|---|---|
| 2,330,699 | 9/1943 | Flamm | 206/147 X |
| 2,397,716 | 4/1946 | Wendher | 206/148 X |
| 5,328,024 | 7/1994 | Sutherland | 206/427 |
| 5,484,053 | 1/1996 | Harris | 206/149 X |
| 5,490,593 | 2/1996 | Gordon et al. | 206/193 X |
| 5,590,776 | 1/1997 | Galbierz et al. | 206/427 |

*Primary Examiner*—Jacob K. Ackun

[57] ABSTRACT

A bottle clip carrier having an upwardly extending handle. The carrier is comprised of upper and lower support panels, each having bottle neck openings and support tabs. In one embodiment the upper support panel is comprised of adhered overlapping flaps, each flap having a handle ply extending from it. In another embodiment the lower support panel is comprised of abutting flaps, each flap having a handle ply extending up through a slot in the upper support panel.

14 Claims, 3 Drawing Sheets

CLIP CARRIER WITH HANDLE

FIELD OF THE INVENTION

This invention relates to clip carriers of the type that employ foldable tabs to engage the underside of flanges on the necks of packaged bottles. More particularly, it relates to carriers of this type which are provided with handles.

BACKGROUND OF THE INVENTION

Beverage bottles are conventionally formed with a flange or shoulder that projects out from the neck. One type of carrier that has been designed to support such bottles in a simple economical manner employs support tabs which are spaced along the edges of bottle neck openings in a carrier support panel. When the panel is pushed down over bottles aligned with the neck openings, the tabs are pivoted up so that their end edges engage the underside of the bottle shoulders. A handle, in most cases comprised of finger holes in the support panel, allows the carrier to be grasped and lifted.

Although finger holes normally function adequately as a handle, most consumers prefer an upwardly extending handle which can be gripped in the manner of a suitcase handle. Such a configuration, however, is substantially more expensive than finger holes, partially due to the carrier having to be set up and loaded by a packaging machine. It would be highly desirable to have a clip carrier which can be set up by hand and is capable of supporting heavy loads.

It is therefore an object of the invention to provide a clip carrier of this type which nevertheless retains the simplicity and economy of the basic clip support tab design.

BRIEF SUMMARY OF THE INVENTION

The invention is directed to a carrier for supporting bottles, each bottle having a neck portion which includes an outwardly projecting flange. The carrier is comprised of an upper support panel which is foldably connected to a lower support panel and engages the lower support panel in face-to-face relationship. Both support panels contain bottle neck openings on opposite sides of a carrier centerline. Support tabs designed to contact the underside of the bottle flanges are connected to the upper support panel by fold lines extending along portions of the periphery of each bottle neck opening in the upper support panel. In addition, an upwardly extending handle is connected to one of the support panels substantially along the centerline of the carrier.

In a first embodiment the upper support panel is comprised of partially overlapped flaps, and the handle is comprised of adhered handle plies extending upwardly from the upper support panel flaps. In a second embodiment the lower support panel is comprised of lower support panel flaps which substantially abut each other along the centerline of the carrier, and the handle is comprised of a handle ply extending upwardly from each lower support panel flap through a slot in the upper support panel. Additional reinforcing plies may be added to the handles. Support tabs may also be provided at the bottle neck openings in the lower support panel in order to further support the bottles.

The carrier is formed from a single blank of substantially rectangular shape which is economical to produce and can readily be attached to bottles.

The features of the invention which enable it to provide the desired results are brought out in more detail in the description of the preferred embodiments, wherein the above and other aspects and benefits of the invention will be apparent.

DETAILED DESCRIPTION OF THE PREFERRED EMBODIMENTS

Figure 1:
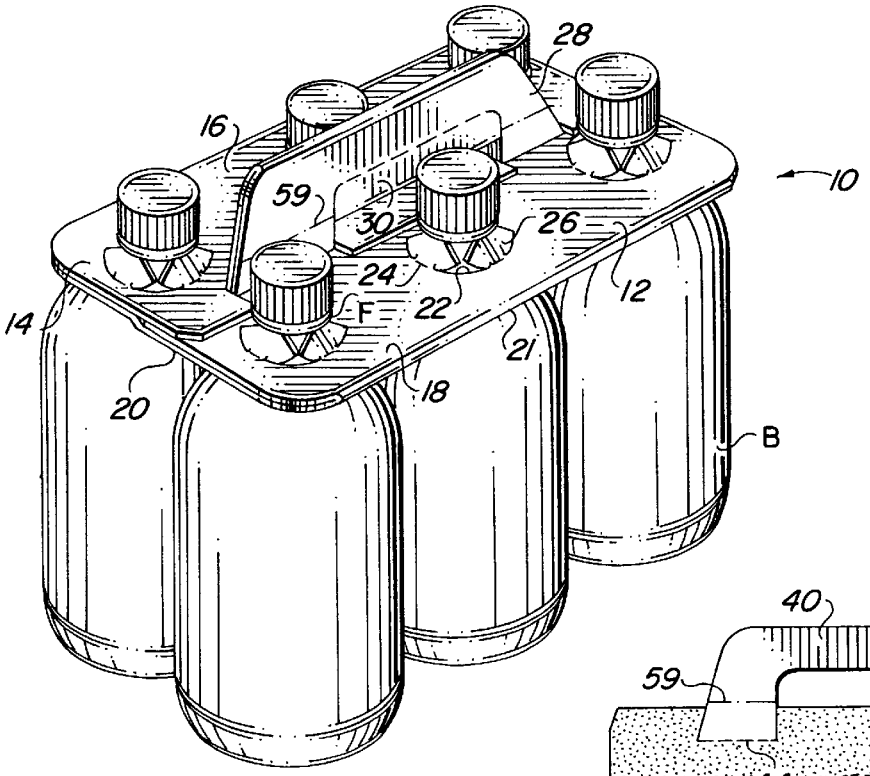
FIG. 1 is a pictorial view of one embodiment of the carrier of the invention.
Figure 2:
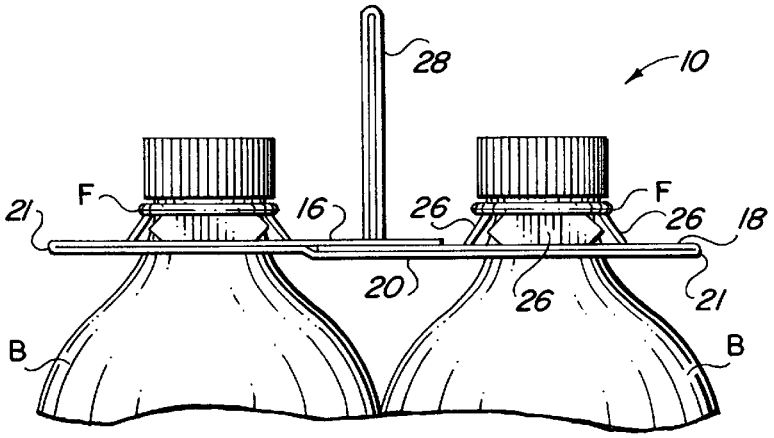
FIG. 2 is an end view of the carrier of FIG. 1.

Referring to FIGS. 1 and 2, the package 10 is comprised of two rows of three bottles B and a carrier 12 for lifting and carrying the bottles. The carrier includes upper support panel 14, comprised of overlapping adhered flaps 16 and 18, and a lower support panel 20 which is in face-to-face contact with the flaps. The upper support panel is connected to the flaps by fold lines 21. Openings 22 in the upper support panel 14 and aligned openings in the lower support panel 20 permit the necks of the bottles to extend through the carrier. Connected to the upper support panel 14 by fold lines 24 are support tabs 26 which are spaced about the periphery of the bottle neck openings 22. The end edges of the support tabs contact the underside of the flanges F on the bottles to support the bottles when the carrier is lifted.

Extending up from the upper support panel is handle 28 which, as best shown in FIG. 2, is of three-ply construction. Tabs 30 on the outer plies provide a cushion to the hand when the tabs are folded under the handle. The handle extends along the centerline of the carrier between the rows of bottles and can be seen to be recessed from the ends of the support panel flaps 16 and 18.

Figure 3:
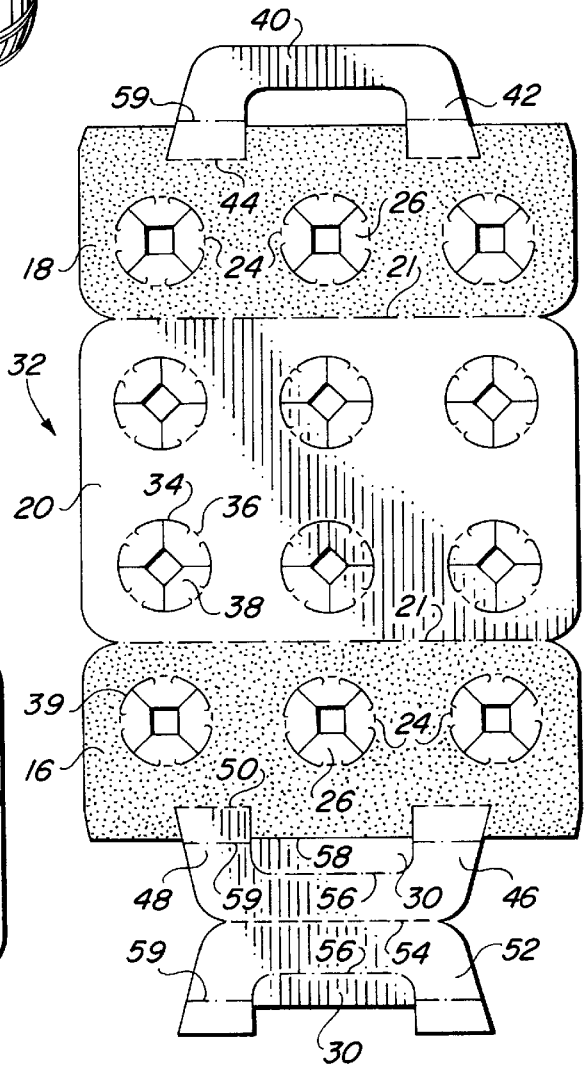
FIG. 3 is a plan view of a blank for forming the carrier of FIG. 1.

A blank 32 for forming the carrier of FIG. 1 is shown in FIG. 3, wherein like reference numerals to those used in FIGS. 1 and 2 denote similar elements. The blank is preferably formed of paperboard, but may be of any suitable material having sufficient strength and flexibility to function in the manner of paperboard. The blank 32 is comprised of a centrally located lower support panel section 20 and two outer flaps 16 and 18 corresponding to the upper support panel flaps of the carrier. Six bottle neck openings, each defined by alternating slits 34 and fold lines 36, are symmetrically arranged about the centerline of the support section 20 in two rows of three each. Support tabs 38 are connected to the lower support section 20 by the fold lines 36 and perform the same function as the tabs 26. The three bottle neck openings in the support flaps 16 and 18, which are located so as to be aligned with the three nearest bottle neck openings in the lower support panel section 20 in a carrier formed from the blank, are formed by alternating slits 39 and fold lines 24.

As in all clip carriers, the diameter of the bottle openings is related to the diameter of the neck portion of the bottles to be packaged so that the flanges on the bottle necks are able to pass through the openings while at the same time contacting the support tabs and pivoting them up about their fold lines. Preferably, the bottle neck openings in the lower support panel section 20 are slightly larger than the openings in the upper support panel flaps 16 and 18 to facilitate alignment. Also, as shown in FIG. 3, the support tabs 38 of the lower support panel section 20 may be angularly offset from the support tabs 26 of the upper support panel flaps 16 and 18 so that the tabs on the lower support panel contact the bottle flanges in portions of the flange circumference which are not engaged by the tabs of the upper support panel. In the illustrated arrangement, where each bottle neck opening is associated with four support tabs, the support tabs 38 are offset from the tabs 26 by 45°.

Still referring to FIG. 3, C-shaped handle reinforcing section 40 is connected at its legs 42 to the upper support flap 18 by fold lines 44. The fold lines 44, which are parallel to the fold lines 21, are inwardly spaced from the outer edge of the flap. Similarly, C-shaped handle section 46 is connected at its legs 48 to the upper support flap 16 by inwardly spaced fold lines 50. In addition, handle section 52, which is essentially the reverse image of the handle section 46, is connected to handle section 46 by fold line 54. Both handle sections 46 and 52 include handle grip tabs 30 which are connected to the handle sections by fold lines 56 and which extend between the legs of the handle sections. The tabs 30 are recessed from the ends of the handle legs. In the case of handle section 46, the outer edge of the tab 30 abuts the outer edge of the support panel flap 16 and is separated from it by the slit 58.

To form a package, glue is applied to the stippled areas of the upper support panel flaps 16 and 18 shown in FIG. 3 and the flaps are pivoted toward each other along the fold lines 21 while at the same time folding the handle sections 40 and 46 back in the opposite direction along fold lines 44 and 50, respectively. The support flap 18 is moved into position first and is adhered to the lower support panel section 20. Support flap 16 is then pivoted into place so that it partially overlaps the support flap 18. The support flap 16 is thus adhered to the lower support panel section 20 and to the overlapped portion of support flap 18 to form the interim carrier structure shown in FIG. 4. The handle sections do not interfere with the formation of the upper support panel of the carrier. At this point the fold lines 44 of the reinforcing handle section 40 are adjacent the fold lines 50 of the handle section 46.

Figure 4:
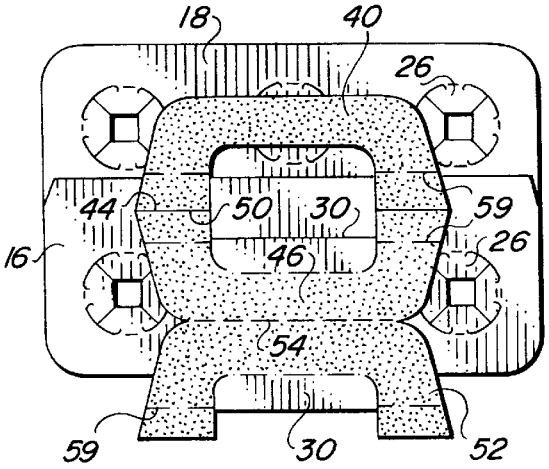
FIG. 4 is a plan view of the blank of FIG. 3 shown after initial folding and gluing steps have taken place.

Glue is then applied to the handle sections 40, 46 and 52, as shown in stipple in FIG. 4, and the handle reinforcing section 40 is folded and adhered to handle section 46. The handle section 52 is then folded over and adhered to the handle reinforcing section 40 to complete the three-ply handle. Preferably, the height of the handle reinforcing section 40 is slightly less than the height of the handle sections 46 and 52 so as not to interfere with the folding of the handle section 52. The handle at this point may be in folded position adjacent the upper support panel or in upright position.

To form a package, the bottles are arranged in two rows of three similar to the arrangement of the bottle neck openings in the carrier. The carrier is then positioned so that the bottle neck openings are aligned with the bottle necks. The connected upper and lower support panels are then pushed down over the tops of the bottles, causing the upper portions of the bottle necks to move through the openings in the support panels, pivoting the support tabs 38 and 26 up in the process. Relative movement between the bottles and the folded blank continues until the flanges F of the bottles move above the edges of the tabs, causing the tabs to snap into place so that the tab edges engage the underside of the bottle flanges.

Forming of the carrier requires only a few simple folding and gluing steps after which it can be clipped into place as described. It does not need to be set up and loaded by machine, thereby eliminating the expense of packaging machinery. It is structurally sound and the three-ply handle not only provides a comfortable, easy means for lifting the package but also is readily capable of withstanding the stresses of lifting and carrying. Although support tabs are disclosed as being provided on the lower support panel 20, they may be eliminated if the carrier load can be adequately supported by the tabs on the upper support panel.

By recessing the fold lines 44 and 50 of the handle sections 40 and 46 from the edges of the upper support panel flaps 18 and 16, respectively, it is possible to overlap the panel flaps while at the same time providing a handle on the centerline of the carrier.

Figure 5:
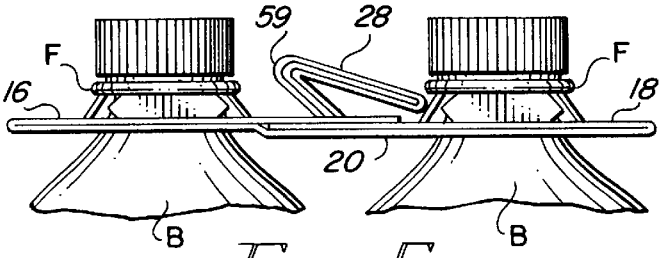
FIG. 5 is an end view similar to that of FIG. 2, but showing the handle in folded condition.

Referring back to FIGS. 1, 3 and 4, it can be seen that the legs of each handle section are provided with a score line 59, each of which is spaced the same distance from the ends of the legs. The score lines 59 in a carrier handle are thus aligned. This arrangement enables the handle of a formed carrier to be folded so as not to interfere with stacking of the packages. As shown in FIG. 5, the three-ply handle 28 has been folded so that its end can be held in place under the flange F of an adjacent bottle B. In this position the fold lines 59 are below the tops of the bottles, thereby allowing the bottoms of bottles in a package to be stacked on the illustrated carrier to be supported by the tops of the bottles of the illustrated carrier. To lift a stacked carrier it is merely necessary to undo the handle from the bottle flange and grasp it in the normal manner.

Figure 6:
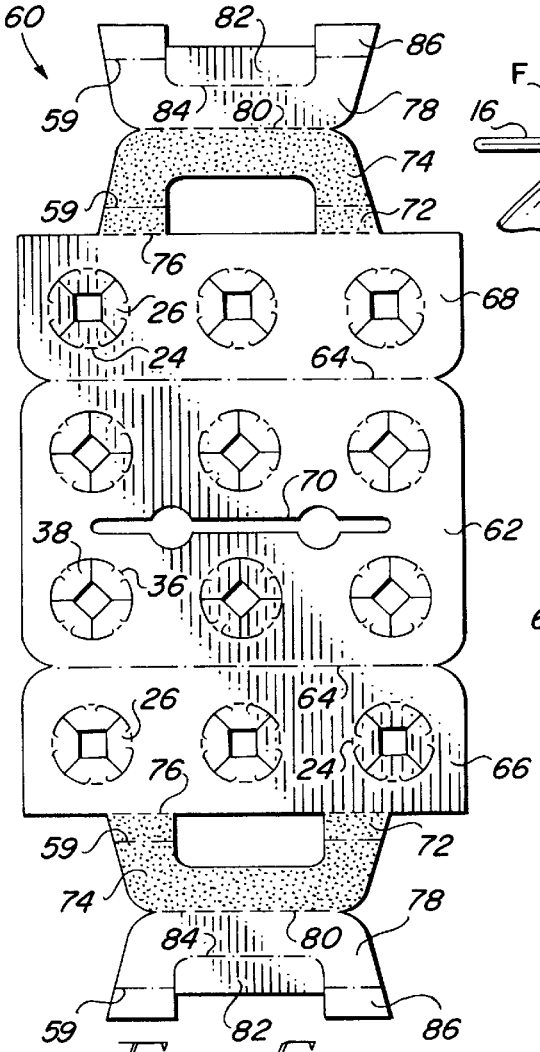
FIG. 6 is a plan view of a blank for forming another embodiment of the carrier of the invention.

A modified form of carrier capable of even greater stress resistance can be formed from the blank 60 shown in FIG. 6. The blank is similar in basic layout to the blank of FIG. 3 in that it includes a centrally located support panel section 62 connected by fold lines 64 to support panel flaps 66 and 68, with bottle neck openings similar to those in the FIG. 3 embodiment present. In this case, however, the support panel section 62 forms the upper support panel of the carrier and the support panel flaps form the lower support panel of the carrier. The upper panel support section 62 includes an elongated slot 70 extending along a major portion of the centerline of the support section, and the handle sections are somewhat different. The legs 72 of C-shaped handle section 74 are connected by fold lines 76 to the outer edge of each lower support flap 66 and 68. Generally similar handle sections 78 are connected to the handle sections 74 along fold lines 80. Each handle section 78 includes a handle tab 82 connected along fold line 84 and extending between the legs 86. The handle tabs 82 are recessed from the ends of the legs 86. Score lines 59 similar in function to the score lines 59 of the first embodiment are provided in each handle section.

Figure 7:
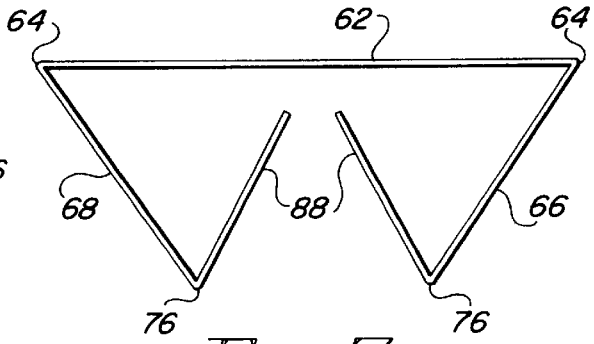
FIG. 7 is an end view of the blank of FIG. 6 at an interim stage of fabrication.
Figure 8:
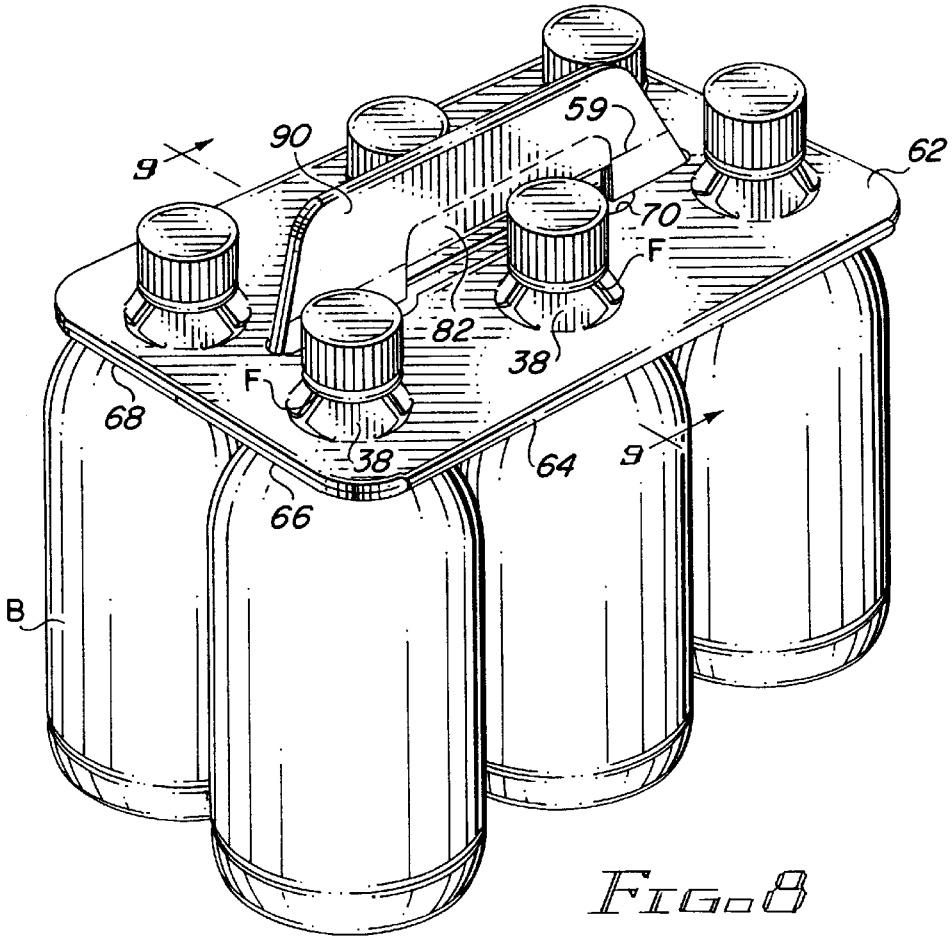
FIG. 8 is a pictorial view of the second embodiment of the carrier of the invention.
Figure 9:
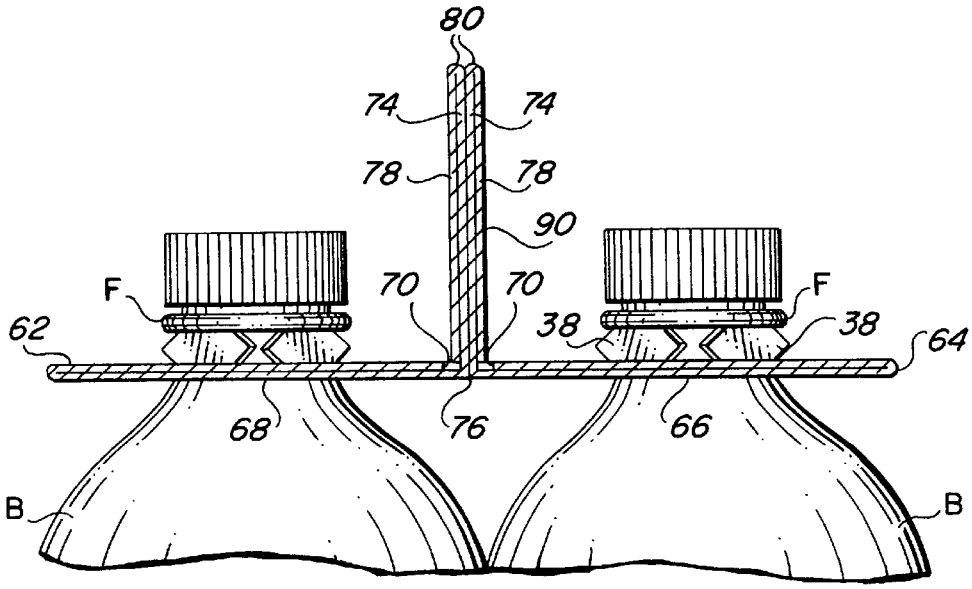
FIG. 9 is a transverse sectional view of the carrier of FIG. 8 taken along line 9—9 of FIG. 8.

To form a carrier from the blank 60, after applying glue to the stippled portions of the handle sections 74 shown in FIG. 6, the outer handle sections 78 are folded about fold lines 80 and adhered to the handle sections 74 to create a two-ply handle section at each end of the blank. The blank is then folded about fold lines 64 and the two-ply handle sections 88, comprised of the adhered handle sections 74 and 78, are folded back up about fold lines 76 toward the upper support panel section 62 as illustrated in FIG. 7. The two-ply handle sections 88 are pushed up through the slot 70 in the upper support panel section 62 to form the carrier shown in FIGS. 8 and 9, wherein the handle is referred to by reference numeral 90.

When lifting the package by the handle of the carrier the stresses exerted on the carrier are distributed between both the upper and lower support panels due to the fact that the handle, being connected to the lower support panel, lifts the lower support panel into engagement with the upper support panel. The handle itself is of adequate strength to withstand the load since it is comprised of four plies. Although the carrier of the first embodiment does not require the additional fabrication steps of the second embodiment, the added strength requirements of heavier loads can make the second embodiment more desirable in such cases. Note also that it is not necessary for the upper and lower support panels to be glued to each other since lifting the package by the handle automatically brings the lower support panel into face-to-face contact with the upper support panel.

As in the first embodiment, the support tabs in the lower support panel may be eliminated if it is determined that they are not necessary in order to adequately support the load of a particular package.

Although the bottles have been shown as having a separate integral flange, the term "flange" as used herein is intended to include the underside of bottle caps in bottles which do not incorporate an integral flange. Obviously, the invention may be practiced in carriers designed to carry fewer or greater than six bottles, as long as the articles are arranged in two adjacent rows.

It can now be appreciated that the invention provides a unique support carrier capable of carrying heavy loads without failure. The features enabling the carrier to function in this way are incorporated into the carrier without requiring expensive carrier blanks or complicated maneuvers by packaging machines.

The invention is not limited to all the specific details described in connection with the preferred embodiments, except as they may be within the scope of the appended claims. Changes to certain features of the preferred embodiments which do not alter the overall basic function and concept of the invention are therefore contemplated.

It is claimed:

1. A bottle clip carrier for supporting bottles having a neck portion which includes an outwardly projecting flange, comprising:

an upper support panel connected along fold lines at opposite edges thereof to a lower support panel and engaging the lower support panel in face-to-face relationship;

the upper support panel and the lower support panel containing bottle neck openings on opposite sides of a carrier centerline;

a plurality of support tabs connected to the upper support panel by fold lines extending along portions of each bottle neck opening in the upper support panel, the support tabs having end edges for engaging the underside of bottle flanges; and an upwardly extending handle connected to one of the support panels substantially along the centerline of the carrier.

2. A carrier as defined in claim 1, wherein the handle includes a hand opening adjacent the upper support panel.

3. A carrier as defined in claim 1, wherein the handle includes score lines spaced from the upper support panel and lying in a plane substantially parallel to the upper support panel, whereby the handle can be folded to permit stacking of packages comprised of similar carriers and bottles supported thereby.

4. A carrier as defined in claim 1, wherein a plurality of support tabs are connected to the lower support panel by fold lines extending along portions of each bottle neck opening in the lower support panel.

5. A carrier as defined in claim 1, wherein the upper support panel is comprised of a first upper support panel flap which partially overlaps and is adhered to a second upper support panel flap, the handle being comprised of a handle ply extending upwardly from each upper support panel flap, the handle plies being adhered to each other.

6. A carrier as defined in claim 5, wherein one of the handle plies is adhered to a reinforcing flap which forms a third handle ply.

7. A carrier as defined in claim 5, wherein the handle ply extending from the first upper support panel flap is recessed from the overlapping edge of said first upper support panel flap.

8. A carrier as defined in claim 1, wherein the lower support panel is comprised of lower support panel flaps which are substantially abutting along the centerline of the carrier, the handle being comprised of a handle ply extending upwardly from each lower support panel flap through a slot in the upper support panel.

9. A carrier as defined in claim 8, wherein at least one of the handle plies is adhered to a reinforcing flap which forms an additional handle ply.

10. A blank for forming a carrier containing two rows of bottles, each bottle having a neck portion which includes an outwardly projecting flange, comprising:

a centrally located support panel section connected along fold lines at opposite edges thereof to support panel flaps;

the support panel section and the support panel flaps having dimensions such that the support panel flaps can be folded about said fold lines so as to partially overlap each other and to be in face-to-face contact with the support panel section;

the support panel section and the support panel flaps containing openings for receiving the necks of the bottles in a carrier formed from the blank;

the openings in the support panel section and in the support panel flaps being located such that the openings in the support panel flaps are aligned with the openings in the support panel section when the support panel flaps are folded about said fold lines;

a plurality of support tabs connected by fold lines along portions of each bottle neck opening in the support panel flaps, the support tabs having end edges for engaging the underside of bottle flanges; and a handle ply connected by a fold line to each support panel flap remote from the centrally located support panel section, the handle plies being located so that they will be in face-to-face condition when folded up from associated partially overlapped support panel flaps.

11. A carrier blank as defined in claim 10, wherein one of the handle plies is foldably connected to a reinforcing flap which forms a third handle ply.

12. A carrier blank as defined in claim 10, wherein the handle ply fold lines are recessed from the edges of the support panel flaps.

13. A blank for forming a carrier containing two rows of bottles, each bottle having a neck portion which includes an outwardly projecting flange, comprising:

a centrally located support panel section connected along fold lines at opposite edges thereof to support panel flaps;

the support panel section and the support panel flaps having dimensions such that the support panel flaps can be folded about said fold lines so as to substantially abut each other and to be in face-to-face contact with the support panel section;

the support panel section and the support panel flaps containing openings for receiving the necks of the bottles in a carrier formed from the blank;

the openings in the support panel section and in the support panel flaps being located such that the openings in the support panel flaps are aligned with the openings in the support panel section when the support panel flaps are folded about said fold lines;

a plurality of support tabs connected by fold lines along portions of each bottle neck opening in the centrally located support panel section, the support tabs having end edges for engaging the underside of bottle flanges;

a handle ply connected by a fold line to each support panel flap remote from the centrally located support panel section, the handle plies being located so that they will be in face-to-face condition when folded up from associated substantially butted support panel flaps; and the centrally located support panel section including a centrally located slot having dimensions enabling the handle plies of the support panel flaps to be inserted upwardly through said slot.

14. A carrier blank as defined in claim 13, wherein at least one of the handle plies is adhered to a reinforcing flap which forms an additional handle ply.

* * * * *